US005195824A

United States Patent [19]

Stromberg et al.

[11] Patent Number: 5,195,824

[45] Date of Patent: Mar. 23, 1993

[54] VESSEL AGITATOR FOR EARLY HYDRATION OF CONCENTRATED LIQUID GELLING AGENT

[75] Inventors: James L. Stromberg; Dennis Brown; Vincent G. Reidenbach; Donald E. Bailey, all of Duncan, Okla.

[73] Assignee: Halliburton Company, Duncan, Okla.

[21] Appl. No.: 685,377

[22] Filed: Apr. 12, 1991

[51] Int. Cl.[5] ..... B01F 15/02

[52] U.S. Cl. ..... 366/131; 366/302

[58] Field of Search ..... 366/297-307, 366/290, 291, 292, 279, 131, 263, 264

[56] References Cited

U.S. PATENT DOCUMENTS

| | | | |
|---|---|---|---|
| 727,032 | 5/1903 | Tubbs | 366/299 |
| 2,767,965 | 10/1956 | Daman | 366/264 |
| 2,845,936 | 8/1958 | Boynton | 366/302 |
| 3,054,230 | 9/1962 | Logue | 366/300 |
| 4,062,526 | 12/1977 | Green | 366/264 |
| 4,772,646 | 9/1988 | Harms et al. | 524/27 |
| 4,828,034 | 5/1989 | Constien et al. | 166/308 |
| 5,046,856 | 9/1991 | McIntire | 366/297 |

OTHER PUBLICATIONS

Exhibit A—Catalog pp. 2-42 and 2-43 of Halliburton Services (undated but admitted to be prior art).

Exhibit B—"Unit Operation of Chemical Engineering", Third Edition by McGraw-Hill (1976), Section 9, Agitation and Mixing of Liquids.

*Primary Examiner*—Robert W. Jenkins

*Attorney, Agent, or Firm*—James R. Duzan; Lucian Wayne Beavers

[57] ABSTRACT

A system is provided for mixing of concentrated liquid gelling agent and water to form a fracturing fluid for fracturing of a subterranean formation. High shear rotary mixers are utilized in a blender tub to provide efficient hydration of the concentrated liquid gelling agent and water mixture.

16 Claims, 3 Drawing Sheets

VESSEL AGITATOR FOR EARLY HYDRATION OF CONCENTRATED LIQUID GELLING AGENT

BACKGROUND OF THE INVENTION

1. Field Of The Invention

The present invention relates generally to the fracturing of wells, and more particularly to a mixer system for mixing concentrated liquid gelling agent and water in an efficient manner to provide rapid and efficient hydration of the concentrated liquid gelling agent.

2. Description Of The Prior Art

It is well known in the oil industry to fracture wells using gelled fracturing fluids to carry sand and other particulate materials into the subterranean formation of the well.

Originally, such gelled fracturing fluids were mixed from dry polymer materials. More recently, it has become common to utilize a concentrated liquid gelling agent which carries the polymer phase dispersed in an oil based fluid. That concentrated liquid gelling agent is mixed with water shortly before the sand or other particulate material is added. Then the sand laden gel is pumped into the well. In order for the gelled fracturing fluid to develop its full viscosity and thus its full sand carrying capacity, it is necessary for the polymer material contained in the concentrated liquid gelling agent to be hydrated, i.e., to absorb water. In the absence of intense shear complete hydration of the gel does not occur for fifteen minutes or more after the guar based polymer is mixed with water. Therefore, continuous mixing of concentrated liquid gelling agent can require holding vessels of very large volumes so that sufficient hydration for proppant support will have occurred before the fluid enters the fracturing blender tub or sand tub.

The time required for the hydration of the gel can be reduced by subjecting the gel to high shear.

The prior art approach to increasing the rate of hydration is represented by U.S. Pat. No. 4,828,034 to Constien et al. which discloses a system utilizing a high shear pump to pump the gel through a static mixer to impart shear energy to the gel. Systems like that of the Constien et al. patent, however, as actually used in the field, still typically require a blender tub operating volume on the order of 200 barrels in order to provide sufficient residence time. A 200-barrel blender tub makes an extremely large unit which is difficult to transport to the field.

Thus, there is still a need for an efficient compact system for mixing of concentrated liquid gelling agents and water to form fracturing fluids.

SUMMARY OF THE INVENTION

The present invention provides a system for mixing of concentrated liquid gelling agent and water to form a fracturing fluid for fracturing of a subterranean formation. The system relies upon a high shear rotary mixing means disposed in the blender tub.

Preferably, the blender tub is divided into first and second zones. First and second rotary mixers are disposed in the first and second zones. The plurality of rotary mixers provides a total circulation flow rate at least an order of magnitude greater than the mixture flow rate through the tub so that an average fluid particle of the mixture passes through the mixers a total of at least ten times while passing through the blender tub.

A total mixer specific energy input from the mixers into the mixture is greater than a total pump specific energy input into the mixture from the various pumps associated with the system. This provides a relatively much more efficient viscosity enhancement of the mixture than would be provided for an equivalent combined total mixer and pump specific energy input wherein the total pump specific energy input exceeded the total mixture specific energy input.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
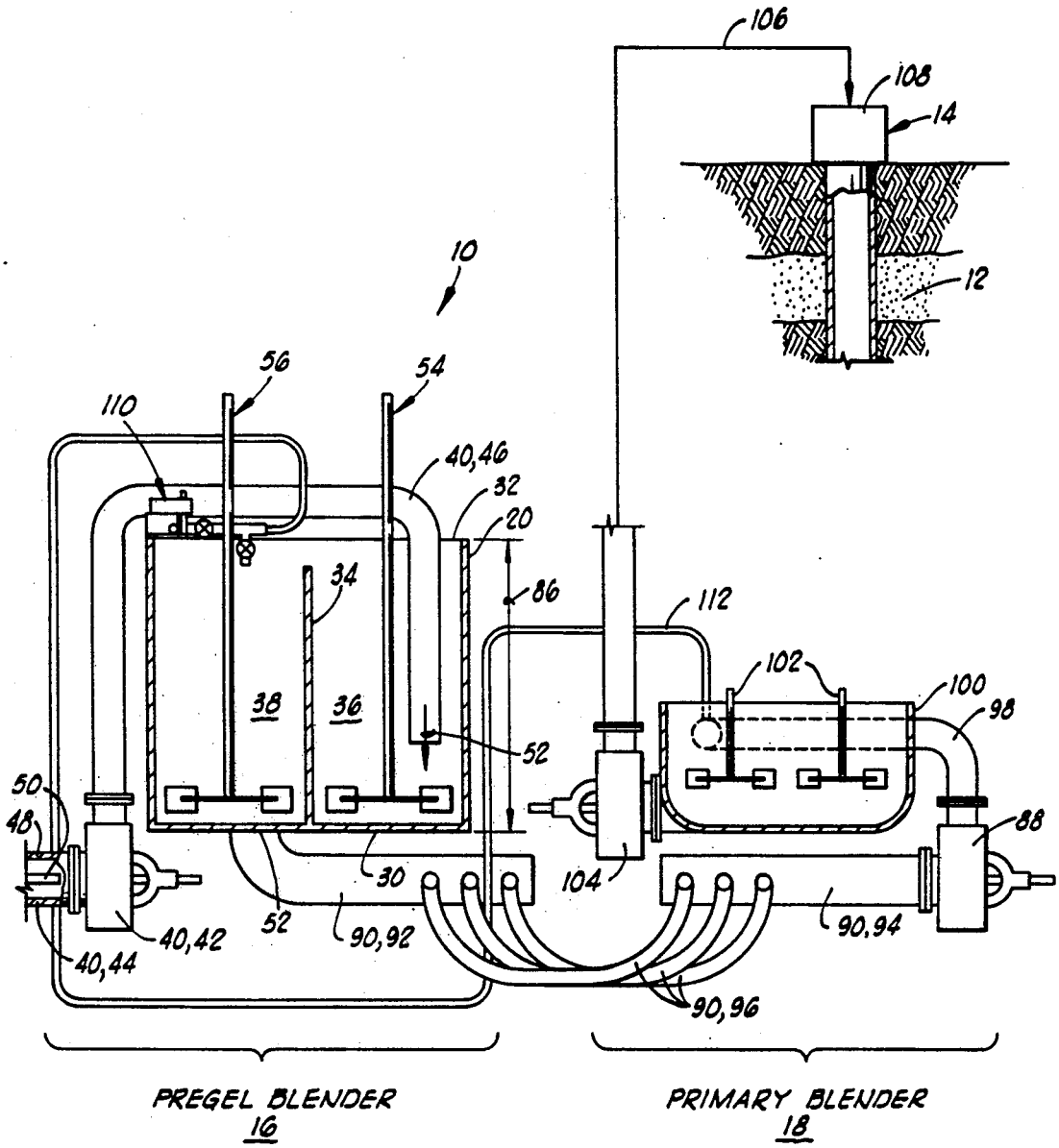
FIG. 1 is a schematic illustration of the mixing system of the present invention.

Referring now to the drawings, and particularly to FIG. 1, a system 10 is thereshown for the mixing of concentrated liquid gelling agent and water to form a fracturing fluid for fracturing of a subterranean formation 12 of a well 14.

The system 10 basically is comprised of a pre-gel blender portion 16 and a primary blender portion 18.

The pregel blender portion 16 includes a blender tub 20 which is generally rectangular parallelpiped in shape having four sides 22, 24, 26 and 28 (see FIG. 5), a closed bottom 30 and an open top 32.

A weir 34 which may be generally referred to as a divider means 34 divides the tub 20 into first and second zones 36 and 38, respectively.

A supply means 40 comprised of a supply pump 42, a mixing manifold 44 and a supply conduit 46 introduces a concentrated liquid gelling agent and water mixture into the open upper end 32 of blender tub 20 at a mixture throughput flow rate. The open upper end 32 of blender tub 20 may also be described as an inlet 32 of the blender tub 20.

The mixing manifold 44 includes a large diameter outer pipe 48 through which an annular water stream flows, and a concentric axially located inner pipe 50 which brings a stream of concentrated liquid gelling agent into contact with the water just prior to the entry of the mixture of those fluids into the suction of the supply pump 42.

The general makeup of typical concentrated liquid gelling agents is described in detail in U.S. Pat. No. 4,772,646 to Harms et al., and U.S. Pat. No. 4,828,034 to Constien et al., the details of which are incorporated herein by reference.

The mixture of concentrated liquid gelling agent and water is introduced by the supply conduit 46 through the open upper end 32 of blender tub 20 into first zone 36. The mixture is directed downwardly as indicated by arrow 51 toward the closed bottom 30 of blender tub 20.

The mixture will then flow up through first zone 36, over weir 34, into the second zone 38 of blender tub 20. An outlet 52 defined in the closed bottom 30 within the second zone 38 allows the mixture to be withdrawn from the second zone 38.

First and second rotary mixers schematically illustrated as 54 and 56 in FIG. 1 are disposed in the first and second zones 36 and 38, respectively. It is noted that the mixers 54 and 56 are only schematically illustrated in FIG. 1 and their size is very much exaggerated in relation to the size of the blender tub 20. The preferred relative dimensions of the mixer and tub are further described below with regard to FIG. 5.

Figure 2:
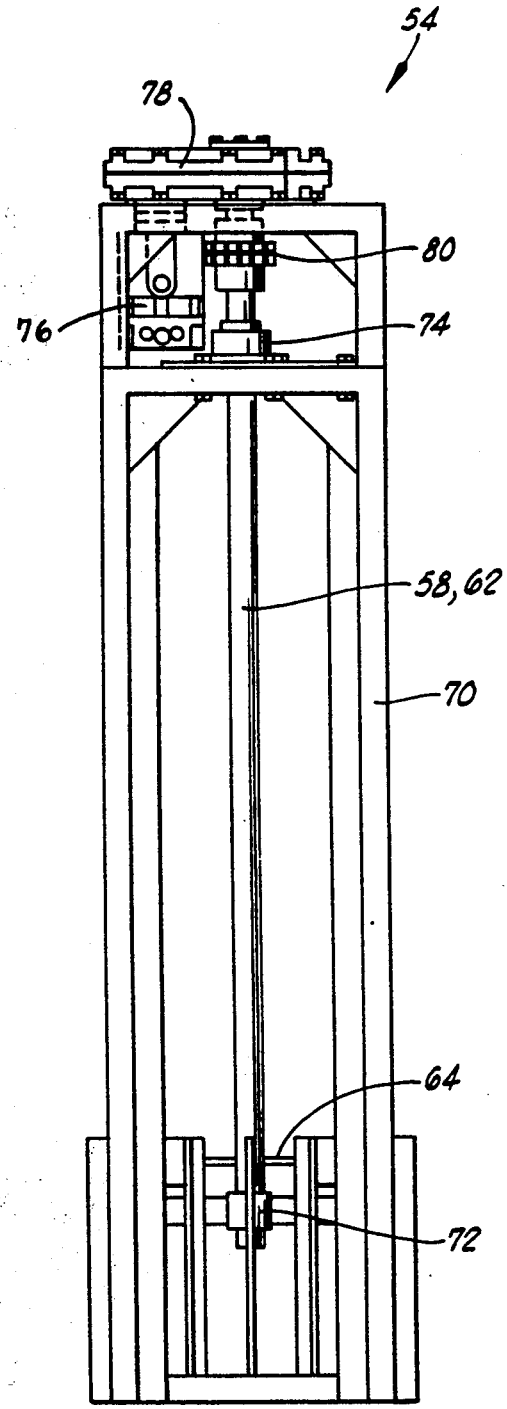
FIG. 2 is an elevation view of one of the rotary mixers utilized with the present invention.
Figure 5:
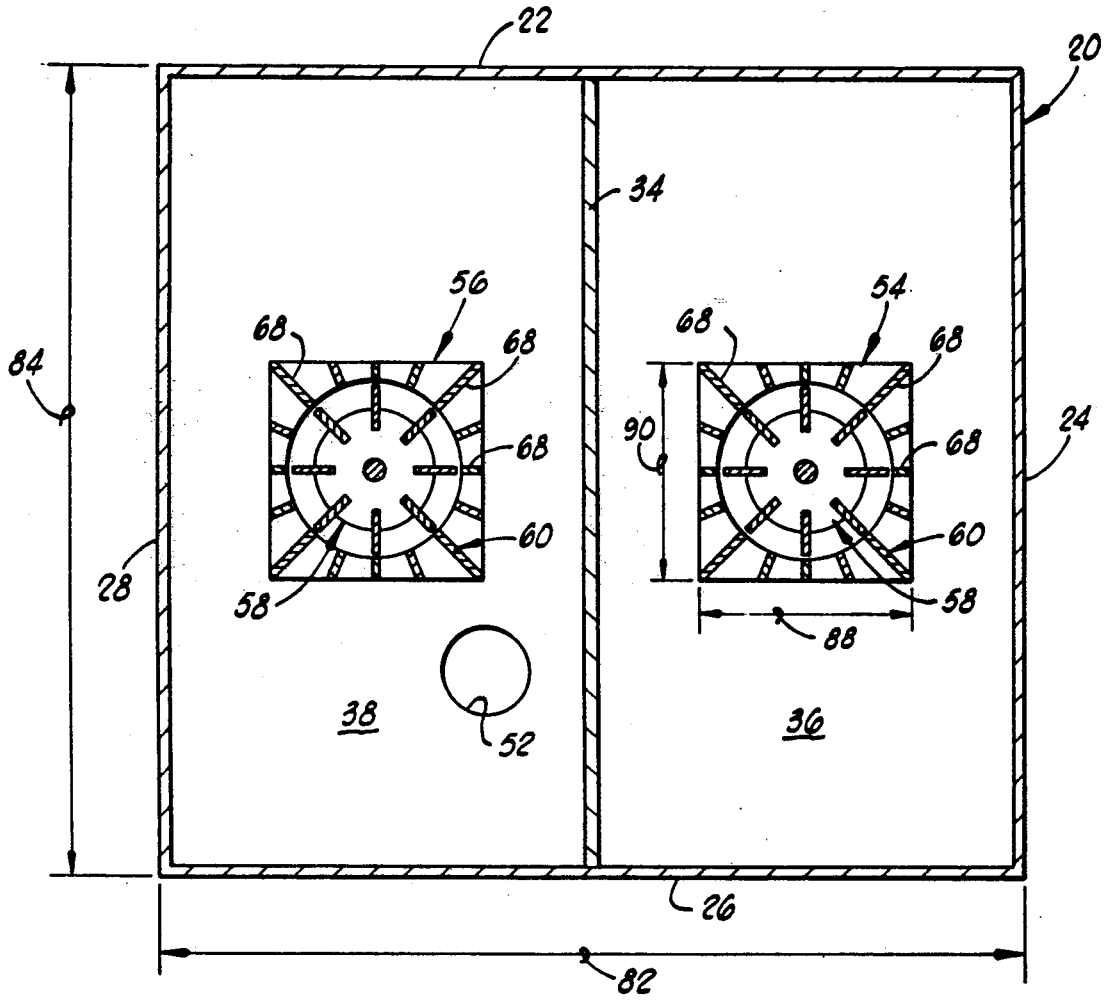
FIG. 5 is a plan view of the blender tub which is approximately to scale and shows the relationship of the two rotary mixers as placed within the two zones of the blender tub.

FIG. 2 is an elevation view of the first rotary mixer 54, and FIG. 5 shows in plan view the location of the first rotary mixer 54 within the first zone 36 of blender tub 20.

Figure 3:
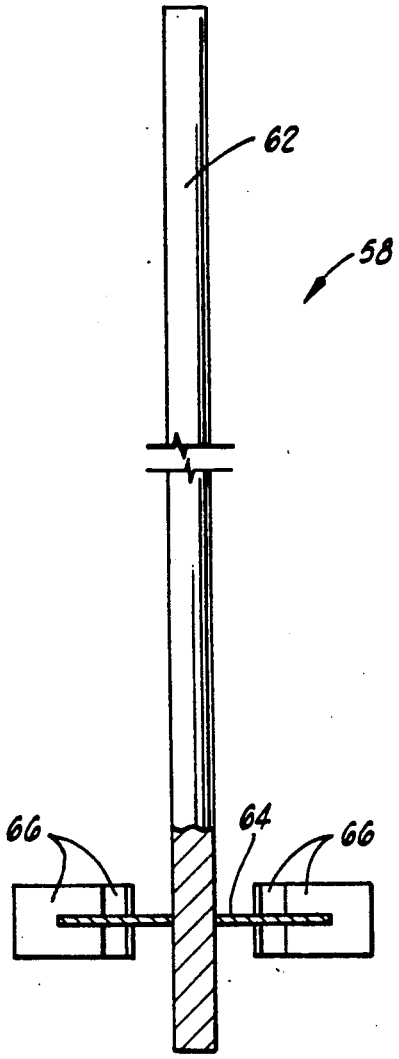
FIG. 3 is an elevation sectioned view of the rotor of the mixer of FIG. 2.
Figure 4:
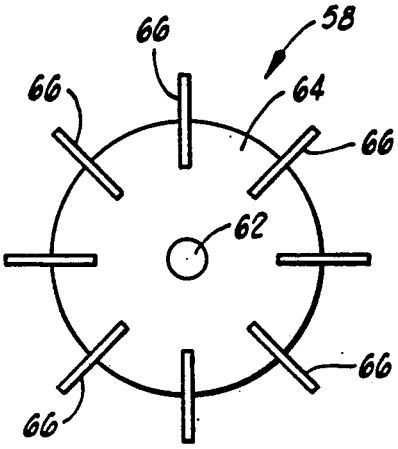
FIG. 4 is a plan view of the rotor of FIG. 3.

The rotary mixer 54 is a high shear rotary mixer and includes a rotor generally designated by the numeral 58 and a stator generally designated by the numeral 60 (see FIG. 5). The rotor 58 as best seen in FIGS. 3 and 4 includes a shaft 62 carrying a disc 64 near its lower end upon which are mounted a plurality of flat non-pitched rotor blades 66. In the illustrated embodiment, there are eight rotor blades 66 on the rotor 58. The stator 60 has sixteen flat non-pitched stator blades 68 as best seen in FIG. 5. There is a relatively small clearance of approximately ¼-inch between the rotor blades 66 and stator blades 68 as the rotor blades 66 rotate within the stator blades 68. This small clearance provides a region of intense shear of the fluid mixture being circulated within the blender tub 20 by the mixers 54 and 56.

The rotor 58 is mounted within a framework 70 having a lower shaft bearing 72 and an upper shaft bearing 74. A motor 76 drives the shaft 62 through a gear box 78 and a flexible roller chain coupling 80.

As best seen in FIG. 5, the rotary mixer 54 is located generally centrally within the first zone 36 of blender tub 20.

The blender tub 20 in a preferred embodiment has a length 82 of approximately 108 inches, a width 84 of approximately 94 inches, a height 86 of approximately 79 inches, and the weir 34 has a height of approximately six feet. This gives the blender tub 20 an operating capacity, that is the volume therein up to height of the weir 34, of approximately 70 barrels. More generally, the blender tub 20 preferably has an operating volume of no greater than 100 barrels, thus providing a relatively compact unit for transport to the field.

The mixer 54 as best seen in FIG. 5 has a framework length 88 and a framework width 90 each of approximately 21½ inches. Rotor 66 has a diameter of approximately eighteen inches across the rotor blades 66. Each of the rotor blades 66 has a radial length of 4.5 inches and a height of 3.6 inches.

The supply pump 42 preferably is a centrifugal pump which can supply the concentrated liquid gelling agent and water mixture to the system 10 at a mixture throughput flow rate ranging from 10 to 100 barrels per minute.

Each of the mixers 54 and 56 in the preferred embodiment has a 107 horsepower motor 76 operating at 550 rpm which provides a circulation rate of approximately 1200 barrels per minute in each of the zones 36 and 38.

The zone volume, approximately 35 barrels for each of the zones 36 and 38, divided by the agitator flow rate of approximately 1200 barrels per minute yields the average time required by a fluid particle to complete a circulation loop through the impeller of one of the mixers. In the case just described, that time is 1.7 seconds per loop. Thus, for an example mixture throughput flow rate from the pump 42 of 70 barrels per minute, a fluid particle would spin an average time of one minute in the 70 barrel holding tank. During that one minute at 1.7 seconds per loop, an average fluid particle would circulate through the impeller of either mixer 54 or mixer 56 a total of approximately 35 times. Thus, the shear history of an average fluid particle in this example is one of 35 extremely short periods of intense shear separated by longer periods of low shear occurring over a time duration of sixty seconds. As further discussed below, this shear history is significantly different than that provided by an enclosed device such as a static mixer which provides a probably higher frequency of intense shear for a much shorter time duration.

Stated in another way, the rotary mixers 54 and 56 can be described as providing a total circulation flow rate (i.e., $2 \times 1200 = 2400$ BPM in the above example) at least an order of magnitude greater than the mixture throughput flow rate (70 BPM in the above example) so that an average fluid particle of the mixture passes through the mixers 54 or 56 a total of at least ten times while passing through the blender tub 20. More preferably the total circulation flow rate is at least twenty times greater than the mixture throughput flow rate, and even more preferably the total circulation flow rate is at least thirty times greater than the mixture throughput flow rate. In the example given the average particle would pass through the mixers 34.29 times (i.e., 2400/70).

Referring again to FIG. 1, the primary blender portion 18 of system 10 includes a primary blender suction pump 88 for pumping mixture away from the outlet 52 of the blender tub 20. The mixture is drawn from the outlet 52 of the blender tub 20 by an outlet conduit 90 comprised of a first manifold portion 92 connected to outlet 52, a second manifold portion 94 connected to the suction inlet of primary blender suction pump 88 and a plurality of flexible hoses 96 connecting the first and second manifold portions 92 and 94. The pregel blender portion 16 and primary blender portion 18 of blender system 10 are typically mounted on separate trailers, and the flexible hoses 96 are utilized to interconnect the components located on the two separate trailers.

The primary blender suction pump 88 discharges the mixture through conduit 98 into a relatively small sand tub 100 having a volume on the order of ten barrels, which is utilized to mix sand or other particulate material with the gelled mixture. Conventional rotary mixers 102 may be used in sand tub 100 to insure thorough mixture of the sand with the gelled fracturing fluid. A blender discharge pump 104 takes the sand laden fracturing fluid from sand tub 100 and pumps it through conduit 106 to positive displacement high pressure pumps (not shown) which discharge to wellhead 108 of the well 14.

A viscometer 110 may be mounted on the blender tub 20 for measuring the viscosity of the mixture entering the sand tub 100. That mixture is supplied to the viscometer 110 through a viscometer feed hose 112.

As previously mentioned, the blender tub 20 in a preferred embodiment has an operating volume of approximately 70 barrels. The sand tub 100 has an operating volume of approximately ten barrels. The various conduits interconnecting all of the components between supply pump 42 and blender discharge pump 104 have a further volume of approximately ten barrels, thus defining an overall system 10 having a volume on the order of ninety barrels. The various locations where shear energy is input into the mixture are primarily the pumps 42, 88 and 104, and the high shear mixers 54 and 56.

We have discovered, as further explained below, that for a given specific energy input into a gelled fracturing fluid, the energy is much more efficiently used to increase hydration of the fluid if the energy is input at lower levels over a longer period of time rather than an intense burst over a very short period of time. Thus, large agitated tanks have been determined to be much more energy efficient viscosity producers than are small volume devices such as centrifugal pumps, static mixers and the like which are inefficient viscosity producers. Thus, it is preferred that a total mixer specific energy input from mixers 54 and 56 into the mixture be greater than the total pump specific energy input from pumps 42, 88 and 104 into the mixture. This provides a relatively more efficient viscosity enhancement of the mixture than would be provided for an equivalent combined total mixer and pump specific energy input wherein the total pump specific energy input exceeded the total mixer specific energy input.

For example, in a laboratory comparison of a high shear rotary mixer with a centrifugal pump the following data was obtained. A Waring blender utilizing a rotor and stator arrangement similar to that of mixer 54 was compared to a laboratory scale centrifugal pump. For equal energy inputs per unit mass of 0.50 calories per gram, the Waring blender produced an initial hydration rate of 17 centipoise per minute while the centrifugal pump's initial hydration rate was only 7.5 centipoise per minute.

As used herein, the term "specific energy input" means mechanical energy input per unit mass of the mixture, which may for example be measured in calories per gram.

The system 10 provides a very compact system. The system 10 has a total system volumetric capacity from the suction of pump 42 which may be considered to be the initial point of combination of the concentrated liquid gelling agent and water, to the discharge of blender discharge pump 104 of no greater than about 100 barrels. The range of mixture throughput flow rates provided by supply pump 42 ranges from a minimum of about ten barrels per minute to a maximum of about 100 barrels per minute. Thus at the minimum flow rate of ten barrels per minute, the system 10 provides a maximum residence time of no greater than about ten minutes for the mixture. For the maximum flow rate of 100 barrels per minute, the system 10 provides a minimum residence time of at least one minute for the mixture.

Theoretical Comparison Of Hydration Efficiencies Of Various Shear Input Devices The following mathematical model of the hydration rate of gels in various shear input devices supports the conclusions stated above for the preference of high shear mixers in a blender tub as contrasted to devices such as high shear pumps with static mixers in line.

Several things are known about the initial hydration rate of any mixing device:

(1) Gel will hydrate in the absence of mixing energy given an initial dispersion.

(2) For a given mixing system, the initial hydration rate is an increasing function of specific mixing power. "Specific mixing power" means the rate at which energy is input to the mixture per gram of mixture.

(3) Some mixing systems produce greater hydration rates than other systems at equivalent specific mixing powers.

(4) Given constant conditions, viscosity develops in an exponential fashion. Mathematically, $$\mu=\mu_\infty(1-e^{-f(t)}), \qquad \text{EQUATION 1}$$

where f is some positive function of time and $\mu_\infty$ is the ultimate viscosity. The constant conditions include temperature, pH, mixing system geometry, specific mixing power, gel concentration, and chemistry. For the above relationship, $$\frac{d\mu}{dt} \sim \mu_\infty \qquad \text{EQUATION 2}$$

A relatively simply model for initial hydration rate that exhibits all of the above behavior is:

$$\frac{d\mu}{dt}\Big|_o = \mu_\infty(C + kp^n) \qquad \text{EQUATION 3}$$

where:

$\mu_\infty$=ultimate apparent viscosity

C=static hydration constant k=mixing system efficiency coefficient p=specific mixing power n=mixing power exponent.

Using the developed model of EQUATION 3 for initial hydration rate, a relationship can be written for initial viscosity development as follows:

$$\mu = \mu_o + \frac{d\mu}{dt}\Delta t \qquad \text{EQUATION 4}$$

$$\mu = 1 + \mu_\infty(C + kp^{0.55})\Delta t_p + \mu_\infty C\Delta t_s \qquad \text{EQUATION 5}$$

where:

$\Delta t_p$=duration of applied mixing power $\Delta t_s$=duration of static condition For an example where:

$\mu_\infty$=38 cp and

C=0.0947 $\text{min}^{-1}$

Then:

$$\mu=1+3.6\,(\Delta t_p+\Delta t_s)+38k\,p^{0.55}\Delta t_p \qquad \text{EQUATION 6}$$

When K=0.458 ($g^n$ $\text{min}^{n-1}$)/$\text{Cal}^n$ (polytron impeller), then:

$$\mu=1+3.6(\Delta t_p+\Delta t_s)+17.4p^{0.55}\Delta t_p \qquad \text{EQUATION 7}$$

Equation 6 is only valid for the early stages of hydration when the plot of viscosity vs. time is approximately a straight line. Equation 6 should probably not be applied for total hydration developments of more than approximately 70% or 80%.

Equation 6 is useful in answering an important question when designing a mixing system. If a given amount of specific mixing energy and hydration time are available, at what specific mixing power level is this available energy most efficiently applied? For example, if 0.5 Cal/g specific mixing energy and one minute of hydration time were available then:

$$p\Delta t_p=0.5$$

and the question is: What values of p and $\Delta t_p$ whose product is 0.5 produce the maximum viscosity in one minute? For example when:

$e=0.5$ Cal/g
$p=0.5$ Cal/g min
$\Delta t_p=1$ min and
$\Delta t_s=0$

Equation 7 results in:

$\mu=16.5$ cp (after one minute)

When:

$e=0.5$ Cal/g
$p=2$ Cal/g min,
$\Delta t_p=0.25$ min, and
$\Delta t_s=0.75$ min

Then Equation 7 results in $\mu=11.0$ cp (after one minute)

Clearly, equivalent amounts of specific mixing energy do not produce equivalent average hydration rates. For any given conditions of specific mixing energy e and available hydration time $\Delta t_p+\Delta t_s$, Equation 6 maximizes when $\Delta t_p$ is maximum and p is minimum since the first two terms are constant. This result is due solely to the value of the specific mixing power exponent n. If n were greater than one, then minimizing $\Delta t_p$ would maximize viscosity for a given specific mixing energy e and hydration time $\Delta t_p+\Delta t_s$. Even though the exact value of n is not known, it is known that $0.40<n<0.70$ and the above conclusions only require that $n<1$.

The above conclusions are significant when designing or recommending mixing procedures for the purpose of producing maximum viscosity in a hydrating gel. The duration of applied mixing power $\Delta t_p$ can be written in terms of volume and flow rate as:

$$\Delta t_p = \frac{V}{Q} \qquad \text{EQUATION 8}$$

where

V=volume of fluid being sheared
Q=flow rate of produced gel.

Since the flow rate in continuous operations is fixed by the job requirements, then $\Delta t_p$ must be maximized by maximizing the volume of fluid being sheared. This result indicates that large agitated tanks are energy-efficient viscosity producers while small-volume devices such as centrifugal pumps, static mixers, etc., are inefficient viscosity producers.

Thus it is seen that the apparatus and methods of the present invention readily achieve the ends and advantages mentioned as well as those inherent therein. While certain preferred embodiments have been illustrated and described for purposes of the present disclosure, numerous changes in the arrangement and construction of the invention may be made by those skilled in the art which changes are encompassed within the scope and spirit of the invention as defined by the appended claims.

What is claimed is:

1. A system for mixing of concentrated liquid gelling agent and water to form a fracturing fluid for fracturing of a subterranean formation, comprising:

a blender tub having an inlet and an outlet;

supply means for introducing a concentrated liquid gelling agent and water mixture to said inlet at a mixture throughput flow rate; and a rotary mixer means disposed in said blender tub for providing a total circulation flow rate at least an order of magnitude greater than said mixture throughout flow rate so that an average fluid particle of said mixture passes through said mixer means a total of at least ten times while passing through said blender tub.

2. The system of claim 1, wherein:

said blender tub includes a divider means for dividing said tub into a plurality of zones including at least a first zone and a second zone arranged so that fluid flowing into said inlet must flow through said first zone and then through said second zone to said outlet; and said rotary mixer means includes at least first and second rotary mixers disposed in said first and second zones, respectively.

3. The system of claim 2, wherein:

said first zone is in direct communication with said inlet so that fluid flowing through said inlet flows immediately into said first zone.

4. The system of claim 2, wherein:

said second zone is in direct communication with said outlet so that said second zone is a final zone of said plurality of zones.

5. The system of claim 2, wherein:

said divider means includes an overflow weir dividing said first and second zones.

6. The system of claim 1, wherein:

said rotary mixer means is a means for providing a total circulation flow rate at least twenty times greater than said mixture throughput flow rate so that said average fluid particle passes through said mixer means a total of at least twenty times while passing through said blender tub.

7. The system of claim 1, wherein:

said rotary mixer means is a means for providing a total circulation flow rate at least thirty times greater than said mixture throughput flow rate so that said average fluid particle passes through said mixer means a total of at least thirty times while passing through said blender tub.

8. The system of claim 1, wherein:

said blender tub has a capacity of no greater than about one hundred barrels thus providing a relatively compact mixing system.

9. The system of claim 1, wherein:

said supply means includes supply pump means for pumping said mixture to said inlet of said blender tub after said concentrated liquid gelling agent and water are first combined;

said system further includes discharge pump means for pumping said mixture away from said outlet of said blender tub; and a total mixer specific energy input from said mixer means into said mixture is greater than a total pump specific energy input from said supply pump means and said discharge pump means into said mixture, thus providing a relatively more efficient viscosity enhancement of said mixture than would be provided for an equivalent combined total mixer and pump specific energy input wherein the total pump specific energy input exceeded the total mixer specific energy input.

10. The system of claim 9, wherein:

said rotary mixer means includes one or more high shear rotary mixers each including a rotor having a plurality of rotor blades and a stator having a plurality of stator blades, said rotor blades and stator blades having a relatively small clearance therebetween for providing a region of intense shear of said mixture as said mixture is circulated within said tub by said mixers.

11. The system of claim 10, wherein:

said rotor blades and stator blades are flat nonpitched blades.

12. The system of claim 10, wherein:

said system has a total system volumetric capacity from an initial point of combination of said concentrated liquid gelling agent and water to a point of discharge of said mixture from said system of no greater than about one hundred barrels thus providing a maximum residence time of no greater than about ten minutes at mixture throughput flow rates of at least ten barrels per minute.

13. The system of claim 1, wherein:

said rotary mixer means includes one or more high shear rotary mixers each including a rotor having a plurality of rotor blades and a stator having a plurality of stator blades, said rotor blades and stator blades having a relatively small clearance therebetween for providing a region of intense shear of said mixture as said mixture is circulated within said tub by said mixers.

14. The system of claim 13, wherein:

said rotor blades and stator blades are flat nonpitched blades.

15. The system of claim 1, wherein:

said system has a total system volumetric capacity from an initial point of combination of said concentrated liquid gelling agent and water to a point of injection of said mixture into a wellhead of no greater than about one hundred barrels thus providing a maximum residence time of no greater than about ten minutes at mixture throughput flow rates of at least ten barrels per minute.

16. A system for mixing of concentrated liquid gelling agent and water to form a fracturing fluid for fracturing of a subterranean formation, comprising:

a blender tub;

supply means for introducing a concentrated liquid gelling agent and water mixture to said blender tub;

a high shear rotary mixer means, disposed in said blender tub, said mixer means including at least one rotor having a plurality of rotor blades and at least one stator having a plurality of stator blades, said rotor blades and stator blades having a relatively small clearance therebetween for providing a region of intense shear of said mixture as said mixture is mixed in said tub;

wherein said blender tub has an operating capacity of no greater than one hundred barrels;

wherein said supply means has a mixture throughput flow rate no greater than one hundred barrels per minute; and wherein said mixer means has a circulation flow rate of at least one thousand barrels per minute so that an average fluid particle of said mixture is circulated past said mixer means at least ten times while passing through said blender tub.

* * * * *